United States Patent [19]

Louderback

[11] 4,184,449

[45] Jan. 22, 1980

[54] LUMBER TREATING MECHANISM

[75] Inventor: Lauren G. Louderback, Prineville, Oreg.

[73] Assignee: Clear Pine Mouldings, Inc., Prineville, Oreg.

[21] Appl. No.: 875,802

[22] Filed: Feb. 7, 1978

[51] Int. Cl.[2] ..... B05C 3/10

[52] U.S. Cl. ..... 118/63; 118/423; 118/DIG. 9

[58] Field of Search ..... 118/423, 30, 424, 63, 118/66, DIG. 9, 426; 134/73, 125, 126, 127

[56] References Cited

U.S. PATENT DOCUMENTS

| | | | |
|---|---|---|---|
| 533,543 | 2/1895 | Loughborough | 118/423 X |
| 1,140,873 | 5/1915 | Carter | 118/63 X |
| 1,673,686 | 6/1928 | Kremmling | 118/30 X |
| 3,429,652 | 2/1969 | Varga | 118/423 X |

*Primary Examiner*—John P. McIntosh
*Attorney, Agent, or Firm*—Eugene M. Eckelman

[57] ABSTRACT

A conveyor is arranged to pass lumber strips through a tank of treating liquid and includes pairs of upper and lower flexible lines arranged to receive lumber pieces therebetween. Hold-down apparatus is engageable with the upper flexible lines and is arranged to force such upper lines toward their lower lines to frictionally hold lumber pieces between the upper and lower lines and also to force the assembly of upper and lower flexible lines and lumber pieces down below the liquid level in the treating tank for coating the lumber pieces during the pass of the conveyor through the tank. In a preferred arrangement, the flexible lines comprise resilient type ropes wherein the conveyor assembly is forced down below the liquid level by a stretching of the ropes. The hold-down apparatus is pivotally supported adjacent one end of the tank and has longitudinally spaced pulleys for guiding the ropes, these pulleys being arranged to vary the submerged length of travel by pivotal adjustment of the hold-down apparatus. The conveyor mechanism is arranged to support lumber strips of varying lengths. Also included in the present mechanism are additional treating apparatus which removes excess treating liquid and which dries the lumber strips, all of such mechanism comprising an in-line arrangement utilizing a minimum of manual handling.

5 Claims, 10 Drawing Figures

LUMBER TREATING MECHANISM

BACKGROUND OF THE INVENTION

This invention relates to new and useful improvements in mechanism for treating lumber such as painting, prepainting, sizing, or any type of coating.

Apparatuses have heretofore been employed for treating lumber for the purpose of painting it or otherwise applying a coating to it. Such apparatus employs mechanical conveyor means which grip the lumber pieces and pass them through paint applying chambers. In the use of this type of apparatus, it is required that the lumber pieces be held on the conveyor without damaging such pieces and it is further required that they be held for movement along the conveyor by a minimum area engagement so that the coating will cover substantially all the area of the pieces. In addition, it is required that substantially precise control be provided for the proper exposure of the lumber pieces to the coating. It is further required that efficient removal of excess coating liquid be accomplished particularly from lumber pieces which may be grooved or notched.

SUMMARY OF THE INVENTION

According to the present invention and forming a primary objective thereof, lumber treating mechanism is provided which accomplishes the coating of lumber pieces by utilizing minimum and damage free gripping areas on the lumber pieces and also providing maximum control as to exposure of the lumber pieces to a coating liquid.

The objectives of the invention are achieved by the use of a treatment tank and a conveyor utilizing pairs of flexible lines which grip the lumber pieces therebetween and move them longitudinally through the liquid in the treating tank. The flexible conveyor consists of a pair of resilient lines arranged to be stretched downwardly through a portion thereof which passes through the treatment tank by overhead hold-down means. Such hold-down means has pivotal support at one end and employs a pair of longitudinally spaced rollers that engage the flexible conveyor and are arranged by pivotal adjustment of the hold-down means to vary the exposure of the lumber pieces to the treating liquid. The conveyor means has structure capable of carrying lumber strips of different lengths. The present mechanism also includes novel means for removing excess treating liquid and furthermore includes drying apparatus, all of such stages of treating the liquid pieces with liquid, removing excess treating liquid, and drying comprising a continuous in-line arrangement which requires only the manual steps of feeding the raw lumber strips at the one end and off bearing the pieces at the discharge end.

The invention will be better understood and additional objects and advantages will become apparent from the following description taken in connection with the accompanying drawings.

DETAILED DESCRIPTION OF A PREFERRED EMBODIMENT

Figure 1A:
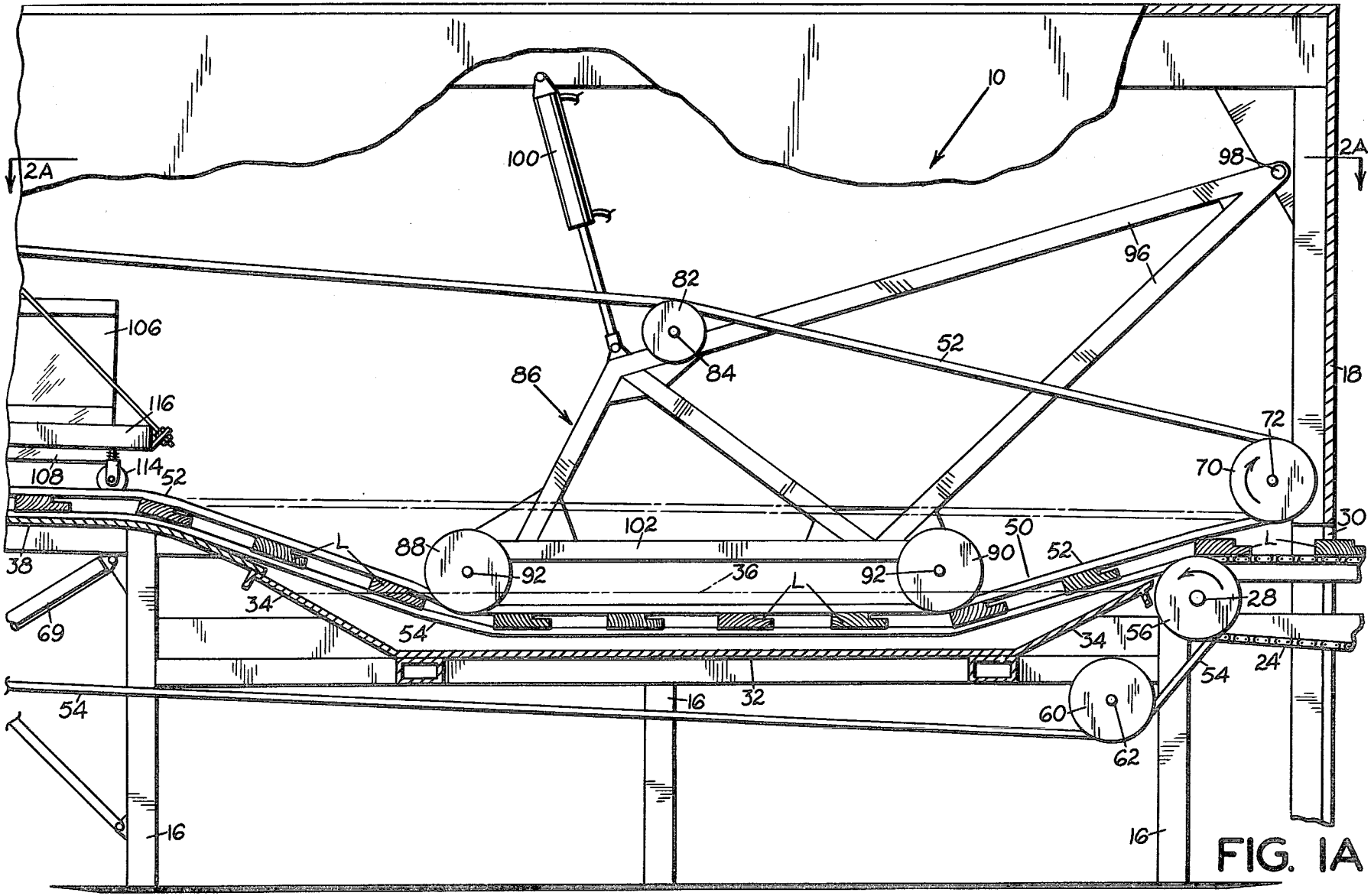
FIGS. 1A and 1B comprise composite views showing stages of liquid treatment and excess liquid removal, these views being taken on the lines 1A—1A and 1B—1B of FIGS. 2A and 2B, respectively.
Figure 1B:
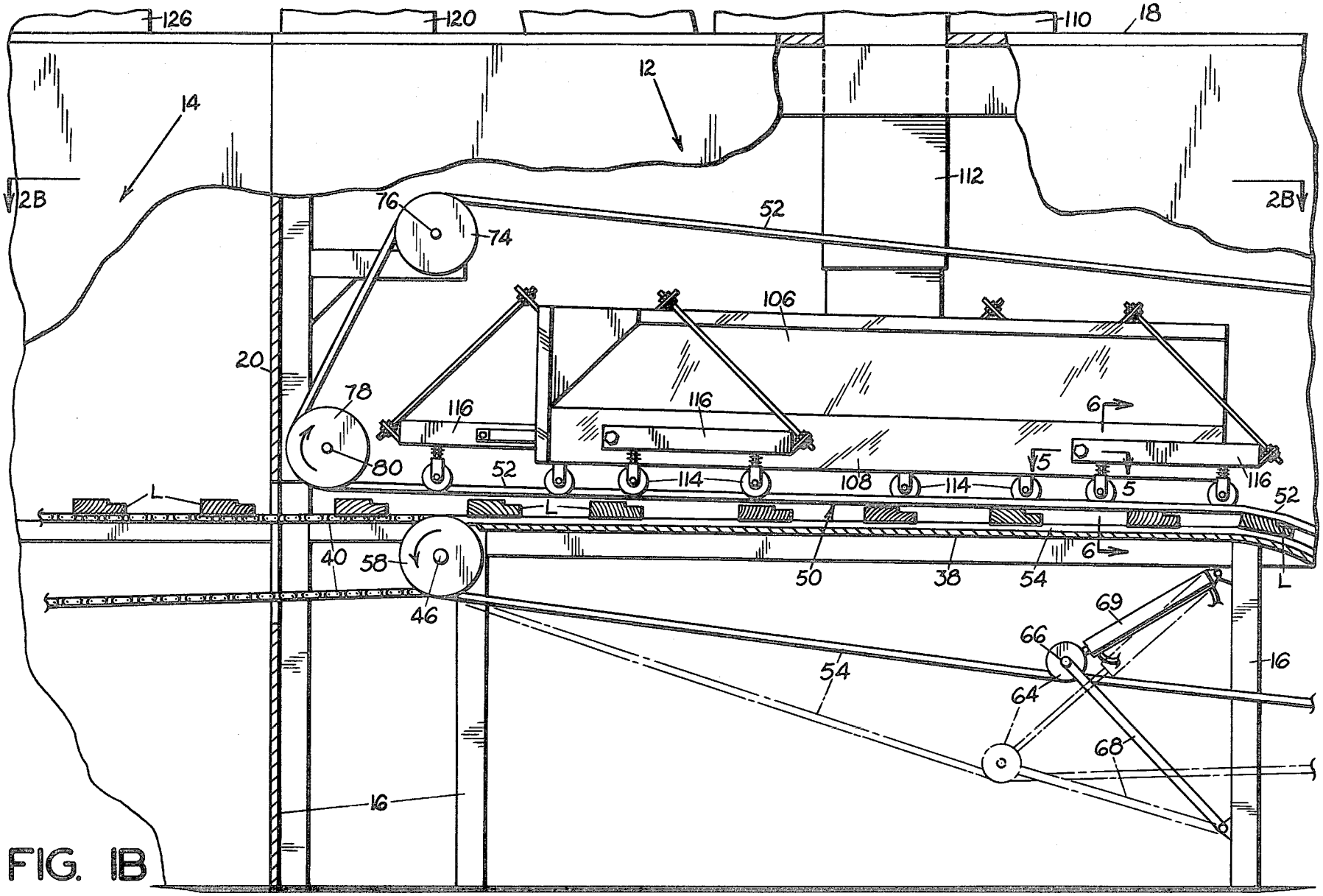
Figure 7:
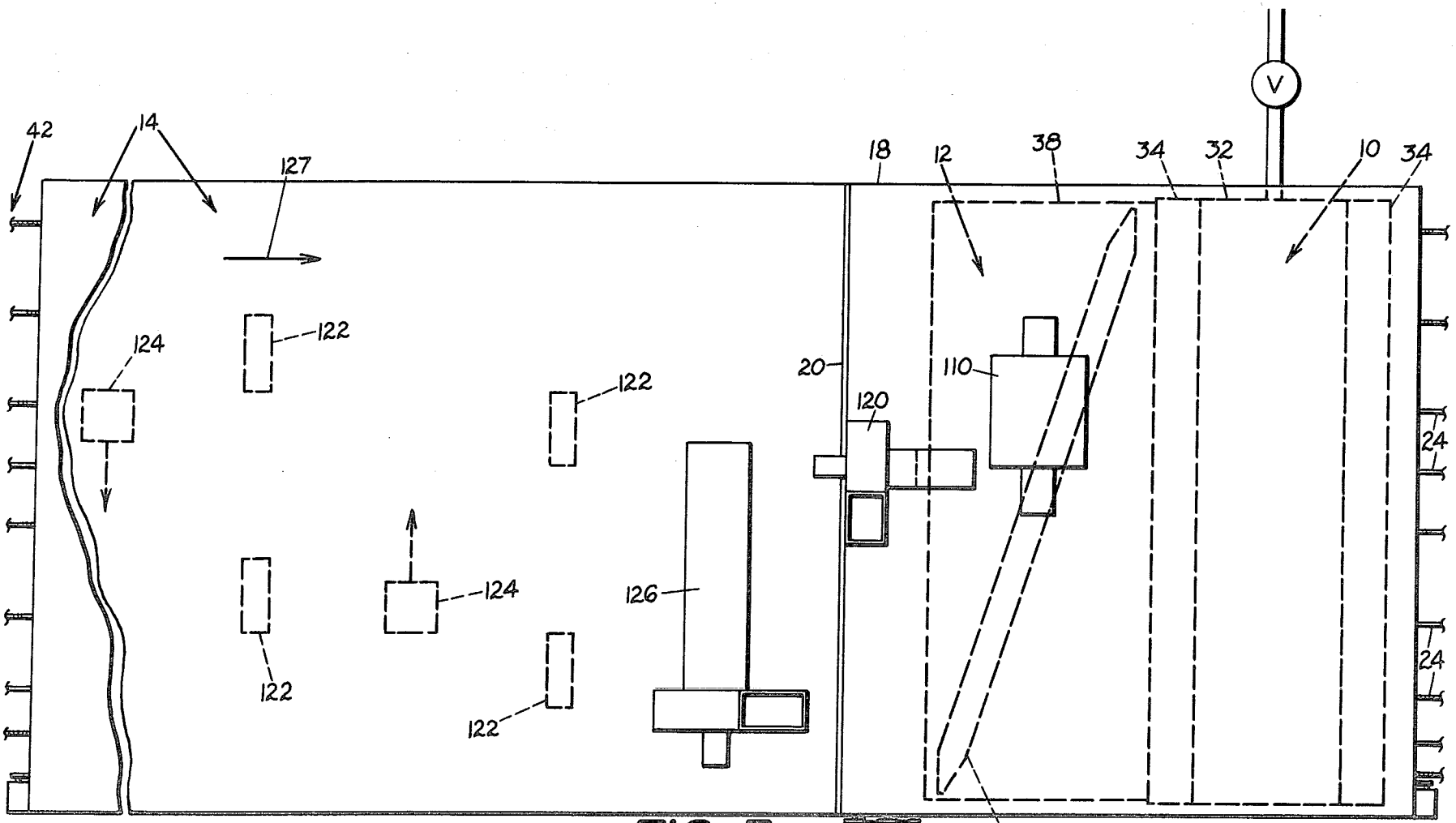
FIG. 7 is a diagrammatic plan view of the excess removal and drying stages of the mechanism.

With particular reference to the drawings, the present mechanism includes in general three areas or stages, comprising a liquid treating area 10, FIG. 1A, an excess liquid removal area 12, FIG. 1B, and a drying area 14, FIG. 7. As will be more apparent hereinafter, these three areas are all in line and provide for liquid treatment, excess liquid removal, and drying, such steps being accomplished without manual handling except for infeed and off bearing. The mechanism is mounted on suitable supporting apparatus 16 and the various areas are enclosed by a housing 18 having end, side and top walls. The various areas are separated by lateral dividing walls 20.

Figure 2A:
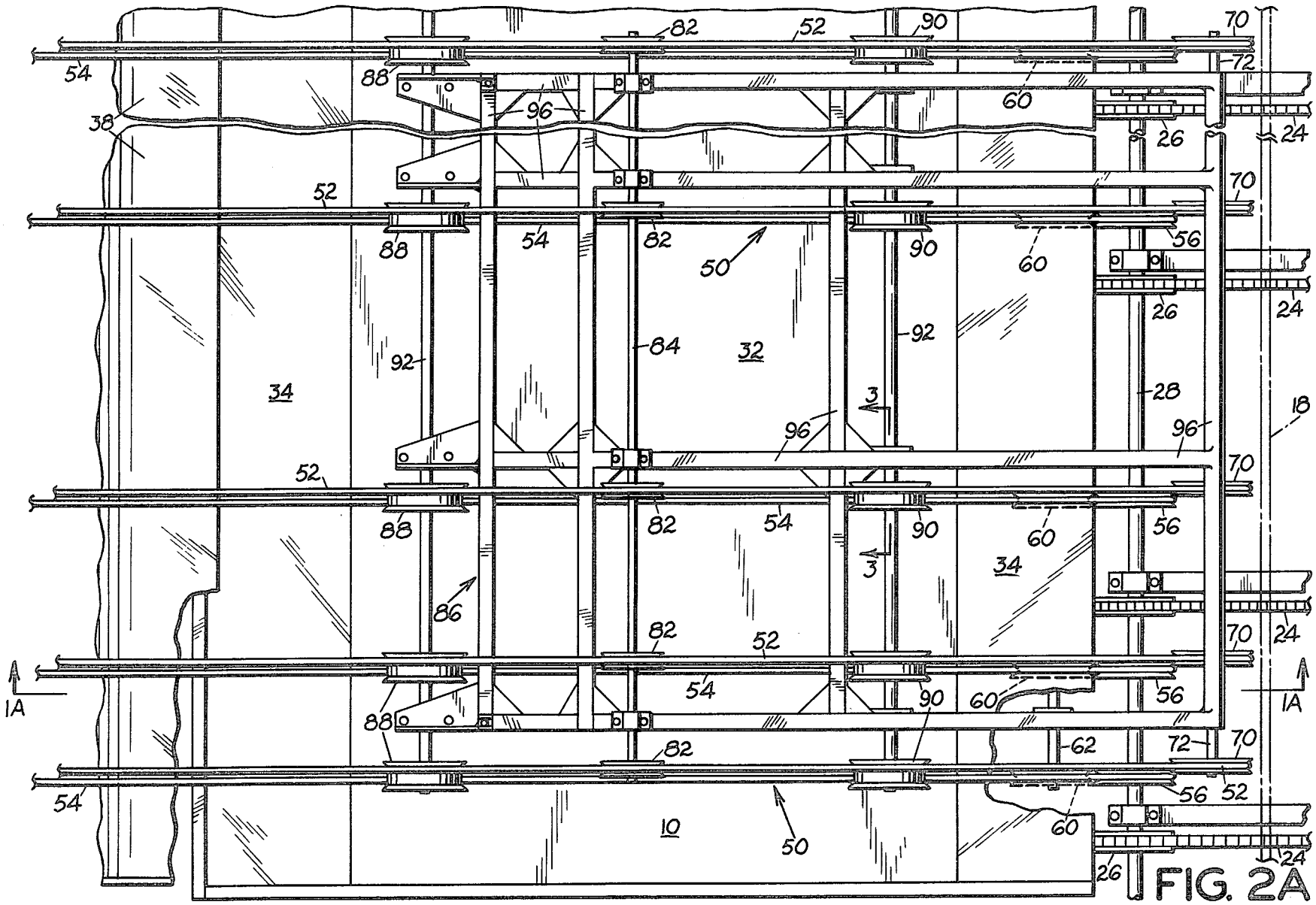
FIG. 2A is a fragmentary foreshortened plan view taken on the line 2A—2A of FIG. 1A and being partially broken away.

The liquid treating area 10 is associated with an infeed conveyor 24, FIGS. 1A and 2A, of a suitable type such as a chain conveyor operating over sprocket wheels 26 keyed on a cross shaft 28 having driven rotation by suitable power means, not shown. The conveyor moves lumber pieces L to the left as viewed in FIG. 1A and operates through an opening 30 in front wall of housing 18.

Disposed in the liquid treating area 10 is a dip tank or reservoir 32 having an open top and inclined ends 34. The liquid level in the tank 32 is designated by the numeral 36. A floor 38 continues from the rearward end of tank 32 through substantially the full length of the excess liquid removal area, FIG. 1B. Wall 38 terminates at the rearward portion of area 12 and a conveyor 40, such as a chain conveyor, receives the lumber pieces at this point and moves them through drying area 14 to an off-bearing area 42 at the rearward end of drying area 14, FIG. 7. Conveyor 40 operates over sprocket wheels 44, FIGS. 1B and 2B, keyed on a cross shaft 46 driven by suitable power drive means, not shown.

The lumber pieces L are carried through the liquid treating area 10 and the excess liquid removal area 12 by a conveyor assembly 50, FIGS. 1A, 1B, 2A and 2B, comprising a plurality of pairs of upper and lower lines 52 and 54, respectively, which are flexible and resilient. The lower lines 54 engage front pulleys 56 journaled for free rotation on shaft 28 and rear pulleys 58 keyed to shaft 46. The bottom or return run of lines 54 engages front pulleys 60 on a cross shaft 62 disposed in a plane lower than cross shaft 28 and such run also engages tensioning pulleys 64 on a cross shaft 66 supported on pivotal arms 68 and associated with a fluid operated cylinder 69 pivotally connected to the supporting frame of the mechanism and arranged, as shown in broken lines, to vary the tension on the lines 54.

The upper lines 52 engage a plurality of free rotating pulleys, comprising pulleys 70 on a cross shaft 72 adjacent the forward end of area 10, pulleys 74 on a cross shaft 78 at an upper point adjacent the rearward end of area 12, pulleys 78 on a cross shaft 80 disposed at a rearward point in area 12 lower than pulleys 74, pulleys 82 on a cross shaft 84 supported at an upper position in area 10 on hold-down apparatus 86 to be described, and longitudinally spaced pairs of pulleys 88 and 90 on cross shafts 92 also supported on the hold-down apparatus 86 in an arrangement now to be described.

Hold-down apparatus 86 comprises a frame 96 having a pivot support connection 98 at an upper and forward portion of area 10. Vertical support for the frame 96 is provided by means of a fluid operated cylinder 100 pivotally connected between such frame and the top wall of the housing. Fluid operated cylinder 100 is arranged to pivot the frame 96 to selected positions and to hold such frame in the selected position.

A lower portion 102 of frame 96 has an elongated longitudinal extending dimension, with the pulleys 88 and 90 supported on their respective shafts at opposite ends of the portion 102, for a purpose to be described.

The lines 52 and 54 are formed of flexible and resilient material such as rubber, urethane plastic, or other suitable material. These lines have tension mounting on the pulleys whereby to maintain a taut engagement with such pulleys such that the lines will span the tank 32 above the liquid level 36 if not engaged by the hold-down apparatus 86. Suitable adjustment of the lower line 54 can be maintained by adjustment of tension pulleys 64.

Figures 2B, 3, 4, 5, 6:
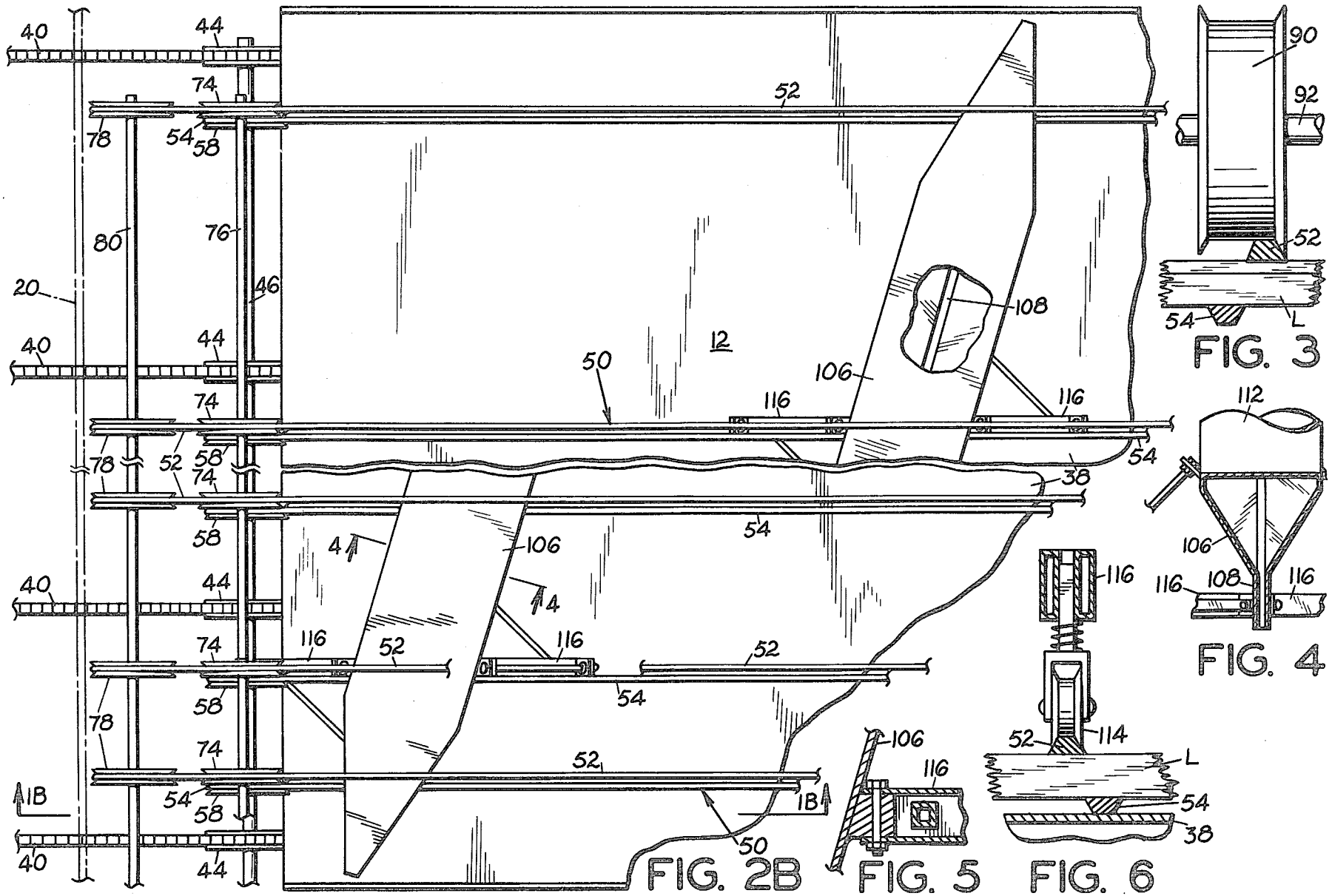
FIG. 2B is a fragmentary foreshortened sectional view taken on the line 2B—2B of FIG. 1B and also being partially broken away.
FIG. 3 is an enlarged fragmentary sectional view taken on the line 3—3 of FIG. 2A.
FIG. 4 is a fragmentary sectional view taken on the 4—4 of FIG. 2B.
FIGS. 5 and 6 are enlarged fragmentary sectional views taken on the lines 5—5 and 6—6 of FIG. 1B, respectively.

The arrangement of the pulleys in the conveyor assembly 50 is such that in lowered positions of the hold-down apparatus 86, lumber pieces L fed in by conveyor 24 move into frictional engagement between the upper and lower lines 52 and 54 and are carried through the treating area 10 and also through the excess liquid removing area 12 to the conveyor 40. The movement of the lumber pieces through the tank 32 is accomplished by lowering the hold-down means 86 to force the upper line 52 down which in turn forces the lumber pieces down against the lower line 54 to frictionally grip the lumber pieces therebetween. Pulleys 88 and 90 are widened to allow guide engagement of lower line therewith in the event that lumber pieces are absent from the conveyor, the lower pulleys 56, 60 and 58 being offset laterally from the upper pulleys as seen in FIG. 2B.

Figure 8:
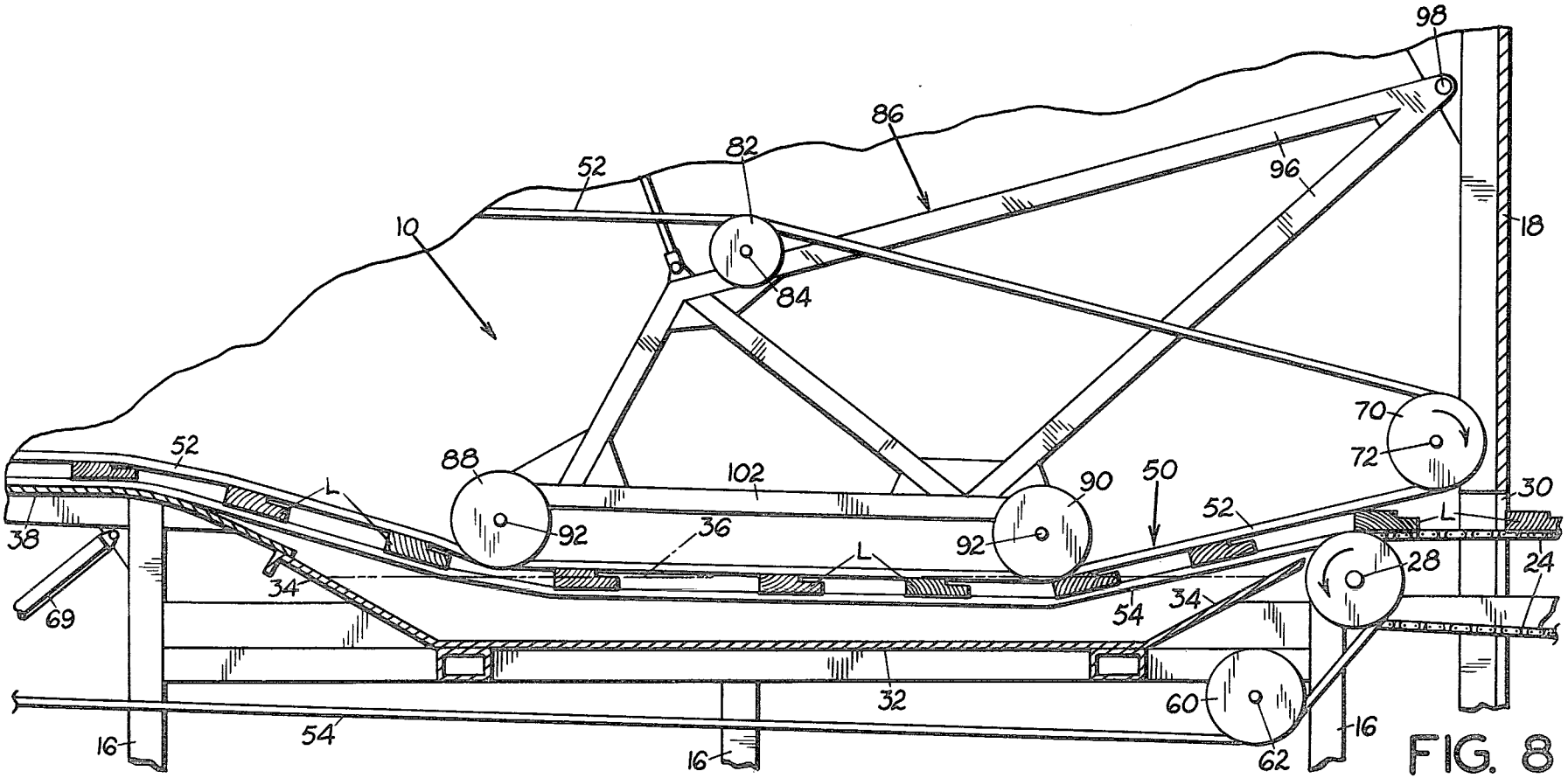
FIG. 8 is a sectional view similar to FIG. 1A but showing a different adjusted position of hold-down means.

The exposure of the lumber pieces to the treating liquid can be controlled by the conveyor speed and also by the longitudinal dimension of the treating tank. Also, exposure time to the treating liquid can be controlled by the vertical positioning of the hold-down apparatus 86 since the higher the adjustment of the hold-down apparatus the less submergence distance of the lumber pieces in the liquid will take place. In addition, since the hold-down apparatus has pivot support 98 at one end, the rear rollers 88 will move up more than the pulleys 90 when the hold-down apparatus is adjusted up and the lower portion 102 will thus angle upwardly toward the rear to cause the lumber pieces to emerge sooner from the treating liquid than when the portion 102 is horizontal or inclined down toward the front. To illustrate this concept, FIG. 1A shows the frame portion 102 substantially horizontal and FIG. 8 shows the frame portion 102 inclined upwardly a slight amount. It is apparent that the positioning of the hold-down apparatus as in FIG. 8 provides less submergence distance of the lumber pieces in the treating liquid than in FIG. 1A, and adjustment up and down can be provided to vary the said submergence distance.

Apparatus for removing excess treating liquid in the area 12 comprises a transverse manifold 106, FIGS. 1B, 2B, 4 and 7, having a full length bottom opening nozzle portion 108. Manifold 106 extends at an oblique angle in the area 12 and receives forced outside air from a fan unit 110 mounted on the top of housing 18 and communicating with the manifold 106 by a telescoping conduit 112. Manifold 106 is supported on the upper line 52 of the conveyor assembly 50 by means of grooved roller assemblies 114, FIGS. 1B and 6, having a spring suspension mounting on outriggers 116 projecting from the manifold 106. Telescoping circuit 112 permits suitable adjustable support of the manifold 106 on the conveyor assembly and the spring suspended roller assemblies 114 allow further for irregularity in the conveyor which may occur from the lumber pieces.

The oblique positioning of the manifold 106 causes the excess treating liquid to be blown to one side. The bottom wall 38 is angled down toward tank 32 whereby excess liquid will flow back into the tank 32. Suitable forced outlet means 120 are employed to discharge fumes.

Drying area 14 employs a plurality of heaters 122, circulating fans 124, and an exhaust fan 126 which causes the drying air to flow counterdirectional to the lumber flow, namely, in the direction of arrow 127. The elements 122, 124 and 126 comprise conventional apparatus and since their structure is well known, they are shown only diagrammatically in FIG. 7. The length of the area 14 as well as the temperature utilized and the speed of the conveyor are precisely controlled for accomplishing the desired drying step.

According to the present invention, a lumber treating mechanism is provided which comprises an in-line assembly wherein all the necessary steps for pre-coating, painting, or the like are accomplished by a single series of steps with a minimum of manual handling. The conveyor mechanism for carrying the lumber pieces through the treating tank and excess liquid removal area is simplified in construction and operation and yet has minimum area engagement with the lumber pieces and with minimum possibility of damage to the pieces. The structure is further simplified in using a common conveyor assembly for moving the lumber strips through the treating area and the excess liquid removal area and has precise exposure control by the speed of the conveyor assembly as well as the positioning of the hold-down apparatus 86.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. Lumber treating mechanism comprising (a) support means, (b) a treating tank on said support means for holding treating liquid, (c) said tank having forward and rearward ends and an open top, (d) conveyor means on said support means movable longitudinally over said tank, (e) said conveyor means including at least one pair of endless upper and lower lines operative over drive and guide pulleys and arranged to receive and frictionally hold lumber pieces therebetween, (f) said upper and lower lines comprising resilient type ropes stretched in a position so as normally to be spaced above a liquid level in said tank, (g) and vertically adjustable hold-down means on said support means engageable with said upper line arranged to force said upper line toward said lower line and frictionally hold lumber pieces therebetween and also to force the assembly of upper and lower lines and lumber pieces down below the level of treating liquid by stretching said lines for treating the lumber pieces as they are conveyed through said tank.

2. The lumber treating mechanism of claim 1 wherein said hold-down means comprises a longitudinally extending frame pivotally supported at an upper point on said support means toward one or the other of said forward and rearward ends of said tank, guide pulleys for said upper line spaced at longitudinal points on said frame whereby selected vertical positioning of said hold-down means on its pivot provides varying longitudinal inclined relationships of said longitudinally spaced rollers whereby to vary the submerged length of travel of the lumber pieces through the treating liquid.

3. The lumber treating mechansim of claim 1 wherein said conveyor means comprises at least three pairs of upper and lower laterally spaced lines with two of said pairs of lines being spaced at different lateral distances apart to accommodate lumber pieces of different lengths.

4. The lumber treating mechanism of claim 1 including second treating means in said mechanism following said treating tank arranged to remove excess treating liquid, said second treating means comprising an overhead laterally extending nozzle ejecting forced air on the lumber pieces, said nozzle being angled at an acute angle relative to said conveyor means whereby to sweep excess treating liquid to one side, said conveyor means extending through said second treating means to carry the lumber therethrough.

5. The lumber treating mechanism of claim 4 including third treatment means in said mechanism following said second treatment means arranged to heat dry the lumber pieces.

* * * * *